US011021342B2

(12) United States Patent
Fukuhara et al.

(10) Patent No.: US 11,021,342 B2
(45) Date of Patent: Jun. 1, 2021

(54) BINDING APPARATUS AND IMAGE FORMING SYSTEM INCLUDING THE SAME

(71) Applicants: Takuya Fukuhara, Kanagawa (JP); Hiroki Yoshida, Kanagawa (JP); Naoyuki Tamura, Kanagawa (JP); Tsubasa Hashimoto, Kanagawa (JP)

(72) Inventors: Takuya Fukuhara, Kanagawa (JP); Hiroki Yoshida, Kanagawa (JP); Naoyuki Tamura, Kanagawa (JP); Tsubasa Hashimoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/716,744

(22) Filed: Dec. 17, 2019

(65) Prior Publication Data

US 2020/0231401 A1 Jul. 23, 2020

(30) Foreign Application Priority Data

Jan. 22, 2019 (JP) ..... JP2019-008779

(51) Int. Cl.
*B65H 37/04* (2006.01)

(52) U.S. Cl.
CPC ..... *B65H 37/04* (2013.01)

(58) Field of Classification Search
CPC ..... B42C 1/12; B31F 5/001; B65H 37/04; B65H 2408/123; G03G 2215/00822; G03G 2215/00827
USPC ..... 270/58.07, 58.08, 58.09
See application file for complete search history.

(56) References Cited

U.S. PATENT DOCUMENTS 5,114,130 A * 5/1992 Hamanaka ..... B26F 1/02 270/58.11
5,221,953 A * 6/1993 Higaki ..... B42C 1/125 270/58.08
5,344,130 A * 9/1994 Suzuki ..... B42C 1/12 270/58.02
6,918,580 B2 * 7/2005 Obregon ..... B25C 5/1689 227/2
8,215,630 B2 * 7/2012 Fujii ..... G03G 15/6582 270/58.09
2010/0019442 A1 1/2010 Yoshida
2010/0237556 A1 9/2010 Azuma et al.
2011/0074081 A1 3/2011 Hirabayashi et al.
2012/0313309 A1 12/2012 Yoshida
2013/0147106 A1 6/2013 Tamura
(Continued)

FOREIGN PATENT DOCUMENTS

JP 2-100964 4/1990

*Primary Examiner* — Leslie A Nicholson, III
(74) *Attorney, Agent, or Firm* — Harness, Dickey & Pierce, P.L.C.

(57) ABSTRACT

A binding apparatus to bind sheets includes a binding device, a non-volatile memory, and control circuitry. The binding device is configured to bind a plurality of stacked sheets with a binding member. The non-volatile memory is configured to store a quantity of binding members in the binding device. The control circuitry is configured to control operation of the binding device. The control circuitry outputs an alert when the quantity of binding members stored in the non-volatile memory is equal to or less than a first predetermined value and cancels the alert when the quantity of binding members is equal to or less than a second predetermined value.

16 Claims, 8 Drawing Sheets

(56) References Cited

U.S. PATENT DOCUMENTS

| | | | | |
|---|---|---|---|---|
| 2014/0138217 | A1 | 5/2014 | Hashimoto | |
| 2015/0336765 | A1 | 11/2015 | Sawada et al. | |
| 2016/0096700 | A1* | 4/2016 | Suzuki | B31F 5/025 412/1 |
| 2017/0267483 | A1 | 9/2017 | Sawada et al. | |
| 2018/0370751 | A1 | 12/2018 | Sawada et al. | |

* cited by examiner

BINDING APPARATUS AND IMAGE FORMING SYSTEM INCLUDING THE SAME

CROSS-REFERENCE TO RELATED APPLICATION

This patent application is based on and claims priority pursuant to 35 U.S.C. § 119(a) to Japanese Patent Application No. 2019-008779, filed on Jan. 22, 2019, in the Japan Patent Office, the entire disclosure of which is hereby incorporated by reference herein.

BACKGROUND

Technical Field

This disclosure relates to a binding apparatus and an image forming system including the binding apparatus.

Description of the Related Art

A binding apparatus is known that forms images on recording media, stacks the recording media, and binds the recording media with a stapler.

In such a binding apparatus, some configurations are known that include a counter to count the number of times of binding (stapling) to detect the remaining quantity of staples.

For example, in a method of counting the number of times of stapling, first, the remaining number of staples is stored in a non-volatile memory. The number of times of stapling is subtracted from the remaining number of staples, and an alert is issued when a predetermined number of times of stapling is performed.

However, since staples are consumables and replenished, the remaining number of staples may not be updated (for example, when the power is off). As a result, the replenishment of staples may not be detected, and stapling may be continued while the remaining number of staples is erroneously recorded.

In such a case, although a sufficient number of staples is actually stored in the binding apparatus, an alert may remain displayed undesirably.

SUMMARY

An embodiment of this disclosure provides a binding apparatus that bind sheets. The binding apparatus includes a binding device to bind a plurality of stacked sheets with a binding member, a non-volatile memory to store a quantity of binding members in the binding device and control circuitry to control operation of the binding device. The control circuitry outputs an alert when the quantity of binding members stored in the non-volatile memory is equal to or less than a first predetermined value and cancels the alert when the quantity of binding members is equal to or less than a second predetermined value.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
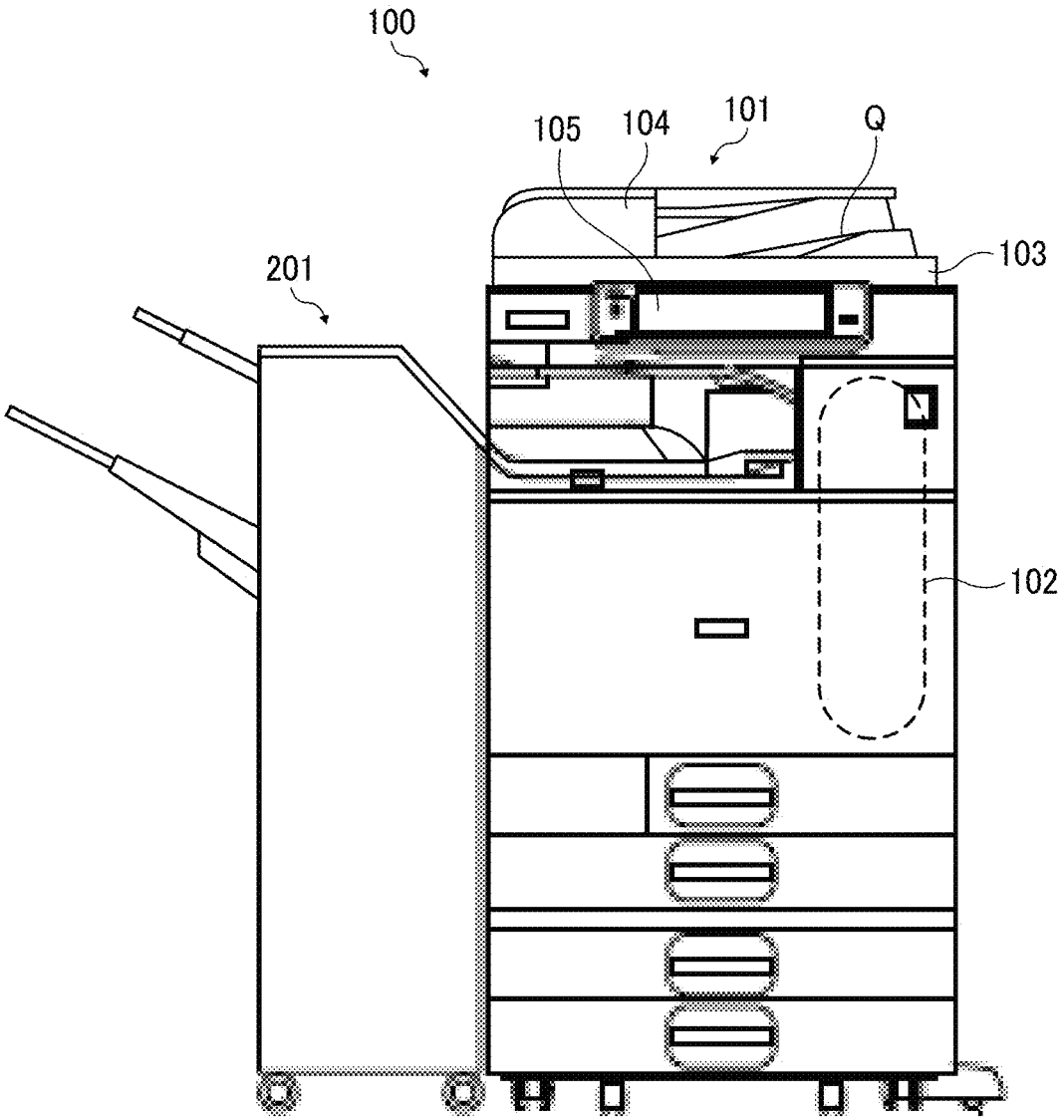
FIG. 1 is a schematic view illustrating a configuration of an image forming system as a whole according to an embodiment of this disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As an example of an embodiment of the present disclosure, FIG. 1 illustrates a schematic configuration of an image forming system 100. The image forming system 100 includes an image forming apparatus 101 to form an image on a sheet as a recording medium and a post-processing apparatus 201 as a binding apparatus.

The image forming apparatus 101 includes an operation-and-display device 105, an image reading device 103 and an auto document feeder (ADF) 104. The operation-and-display device 105 gives instructions to the image forming apparatus 101 in response to user operation. The image reading device 103 reads an original document Q. The ADF 104 feeds and transfers the original document Q into the image reading device 103.

The image forming apparatus 101 further includes an image forming device 102. The image forming device 102 forms an image onto a surface of a sheet P according to image data of the original document Q read by the image reading device 103.

In the description of the present embodiment, the case is described where the image forming apparatus 101 operates as a so-called copying machine that reads image information from an image formed on a surface of the original document Q and copies the image onto the sheet P. However, embodiments of the present disclosure are not limited to the above-described configuration. For example, a configuration in which an image sent from an external terminal is formed on a surface of the sheet P may be employed, and embodiments of the present disclosure are not limited to a specific image forming method.

The image forming device 102, the image reading device 103, the ADF 104, the operation-and-display device 105, and the like have a general configuration as an image forming apparatus.

Figure 2:
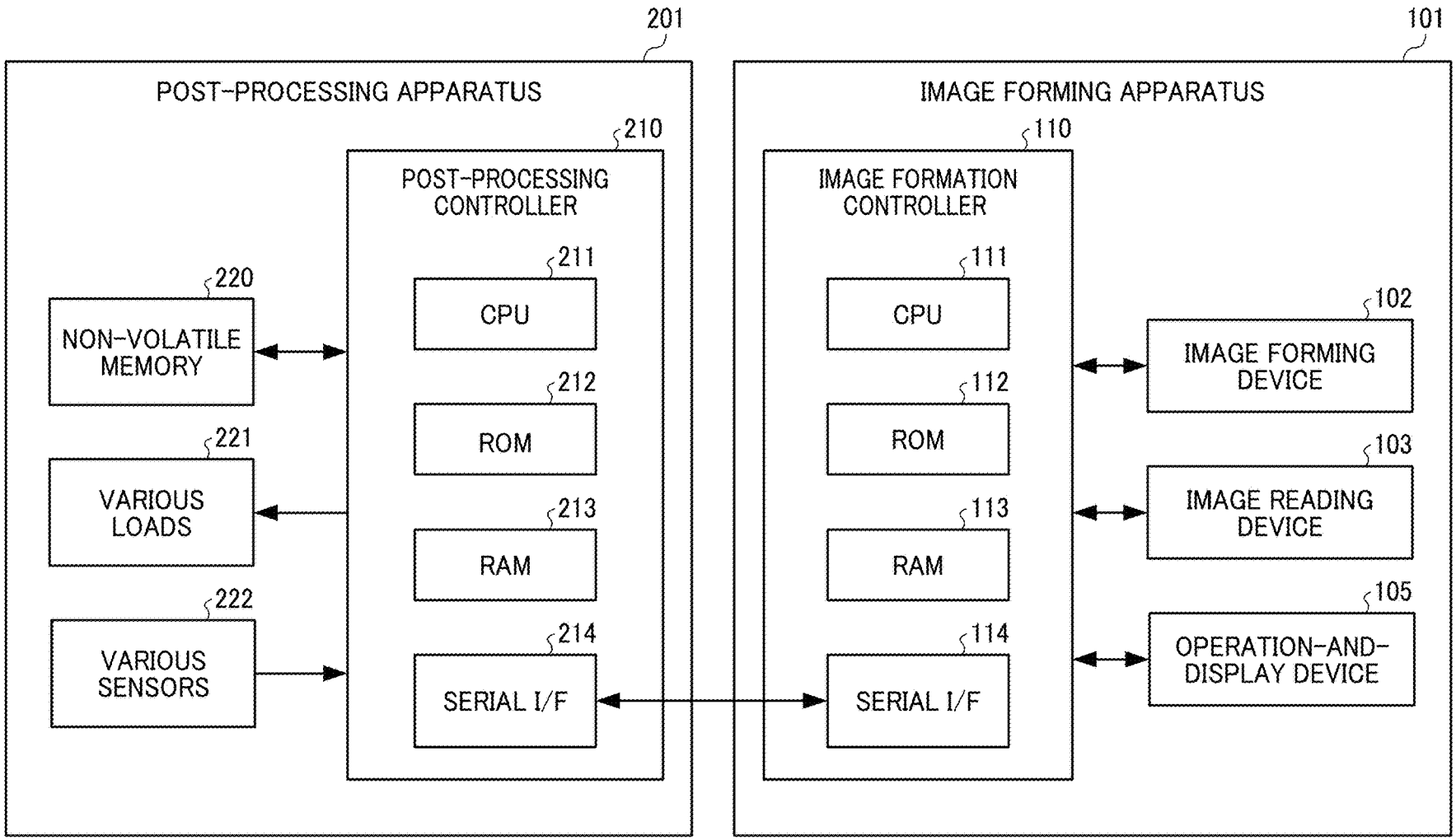
FIG. 2 is a block diagram illustrating an example of a configuration of a control unit of the image forming system illustrated in FIG. 1.

The image forming apparatus 101, as illustrated in FIG. 2, includes an image formation controller 110 that controls various functions related to image formation.

The image formation controller 110 is a computer that includes a central processing unit (CPU) 111, a read only memory (ROM) 112, a random access memory (RAM) 113, a serial interface (I/F) 114, and the like. A controlling program is stored in the ROM 112. The CPU 111 reads the program stored in the ROM 112, loads the program into the RAM 113, stores data necessary for the control in the RAM 113, and performs the control defined by the program using the RAM 113 as a work area.

The image formation controller 110 is connected with the image forming device 102, the image reading device 103, and the operation-and-display device 105. The image forming device 102, the image reading device 103, and the operation-and-display device 105 are controlled via the image formation controller 110.

Similarly, the post-processing apparatus 201, as illustrated in FIG. 2, includes a post-processing controller 210 that controls various functions related to a sheet binding process, a non-volatile memory 220, and various sensors 222. The post-processing apparatus 201 further includes various components such as rollers, motors and a stapler, which are collectively illustrated as various loads 221 in a block diagram of FIG. 2.

The post-processing controller 210 is a computer that includes a CPU 211, a ROM 212, a RAM 213, a serial I/F 214, and the like. A controlling program is stored in the ROM 212. The CPU 211 reads the program stored in the ROM 212, loads the program onto the RAM 213, stores data necessary for the control in the RAM 213, and performs the control defined by the program using the RAM 213 as a work area to control the loads 221.

The non-volatile memory 220 has a function as a non-volatile memory that stores various types of data including a state of the post-processing apparatus 201 such as the remaining number of staples stored in the post-processing apparatus 201, adjustment data, and the like.

The image forming apparatus 101 and the post-processing apparatus 201 are connected via the serial I/Fs 114 and 214, and perform communication such as exchange of commands necessary for sheet conveyance control.

Figure 3:
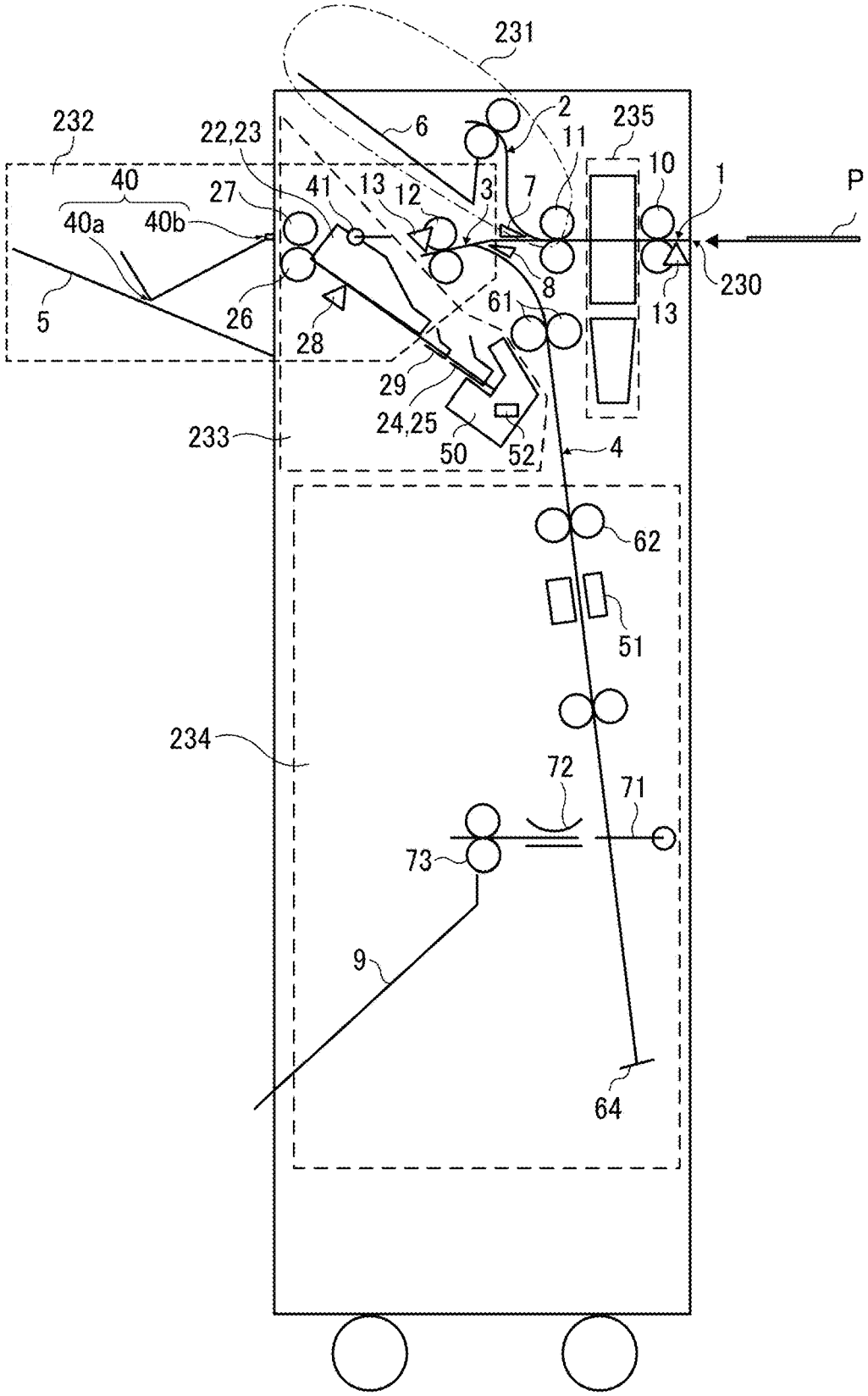
FIG. 3 is an illustration of a configuration of a post-processing apparatus illustrated in FIG. 1.

The post-processing apparatus 201, as illustrated in FIG. 3, includes a sheet receiving unit 230, a proof ejection unit 231, a shift ejection unit 232, an edge binding unit 233, a saddle-stitching and folding unit 234, and a punching unit 235. The sheet receiving unit 230 receives the sheet P from the image forming apparatus 101. The proof ejection unit 231 conveys the sheet P. The shift ejection unit 232 adjusts collating positions of the sheet P. The edge binding unit 233 as a binding device binds an edge portion of the sheet P. The saddle-stitching and folding unit 234 performs saddle stitching and folding of the sheet P, and the punching unit 235 makes holes on the sheet P.

The sheet receiving unit 230 includes an introduction path 1. The introduction path 1 receives the sheet P, on which an image has been formed, discharged from the image forming apparatus 101. The sheet receiving unit 230 further includes an upper conveyance path 2, a straight conveyance path 3, and a lower conveyance path 4 that are three branch paths branched from the introduction path 1.

The sheet receiving unit 230 includes an entrance sensor 13, an entrance roller 10, a horizontal conveyance roller 11, and separators 7 and 8. The entrance sensor 13 detects the sheet P entering the introduction path 1. The horizontal conveyance roller 11 is disposed downstream from the entrance roller 10 in a direction of conveyance of the sheet P. The separators 7 and 8 switch the direction of conveyance path of the sheet P from the introduction path 1 to the upper conveyance path 2, the straight conveyance path 3, and the lower conveyance path 4.

When the sheet P enters the sheet receiving unit 230, the post-processing controller 210 (See FIG. 2) determines a post-processing necessary for the sheet P based on an instruction from the image formation controller 110. Also, based on an instruction from the post-processing controller 210, the entrance roller 10, the horizontal conveyance roller 11, and the separators 7 and 8 operate to change conveyance path of the sheet P.

The proof ejection unit 231 is connected with the upper conveyance path 2 of the sheet receiving unit 230 and includes a proof tray 6.

The traveling direction of the sheet P is changed by the separator 7 from the introduction path 1 and the sheet P is ejected to the proof tray 6.

The shift ejection unit 232 is connected with the straight conveyance path 3, and includes an intermediate conveyance roller 12, an output tray 5, a sheet ejection roller 26 and a driven roller 27 as a pair of rollers facing each other and a sheet ejection sensor 28. The intermediate conveyance roller 12 includes a shift mechanism to change the position of the intermediate conveyance roller 12.

The sheet P ejected from the straight conveyance path 3 is shifted in a direction perpendicular to the direction of conveyance by a certain distance when the shift mechanism moves the intermediate conveyance roller 12 in the direction perpendicular to the direction of conveyance by a certain amount. As a result, the sheet P is sandwiched between the sheet ejection roller 26 and the driven roller 27 and sequentially ejected and overlaid onto the output tray 5.

As described above, when the sheet P is sandwiched between the sheet ejection roller 26 and the driven roller 27, the driven roller 27 or a sheet ejection guide plate equipped with the driven roller 27 approaches and separates from the sheet ejection roller 26. Owing to this mechanism, a closed state in which the sheet P can be ejected and an open state in which the sheet P is not sandwiched can be selected. After the position shift of the sheet P is completed, the shift ejection unit 232 controls to set the distance between the sheet ejection roller 26 and the driven roller 27 to the closed state and eject sheets P or a bundle of the sheet P of which the position is shifted.

The shift ejection unit 232 also includes a feeler 40 near an upper portion of an ejection port.

The feeler 40 is rotatably disposed near the center of the sheet P discharged to the output tray 5, and a projecting edge 40*a* of the feeler 40 contacts an upper surface of the sheet P.

The feeler 40 is provided with an upper surface detection sensor 40*b* that detects the height of the projecting edge 40*a* of the feeler 40. When the upper surface detection sensor 40*b* detects that the height of the projecting edge 40*a* of the feeler 40 is equal to or greater than a predetermined value, the output tray 5 is lowered via the post-processing controller 210.

Thus, by lowering and raising the position of the output tray 5, even when a large number of the sheet P is discharged, the sheet ejection operation from a sheet outlet can be stably performed. Further, when the output tray 5 reaches a lower limit position, that is, a position where the output tray 5 becomes full, the post-processing controller 210 may issue a stop signal to the image formation controller 110 to stop an image forming operation of the image forming system 100.

The edge binding unit 233 includes a staple tray 21, a return roller 41, joggers 22 and 23 that align the position of the sheet P in a width direction of the sheet P, rear end fences 24 and 25 that align the position of the sheet P in a length direction, and a stapler 50 as a binder.

The edge binding unit 233 includes a staple sensor 52 to detect the presence or absence of staples loaded in the stapler 50.

The edge binding unit 233 aligns and stacks sheets P conveyed to the staple tray 21, using the joggers 22 and 23, and the rear end fences 24 and 25. The stapler 50 moves in a direction perpendicular to a sheet surface of the bundle of the sheet P to bind a bundle of sheets P, which is aligned and stacked, at a lower edge portion of the bundle of the sheets P at an appropriate position.

The operation described above is a binding operation. The bundle of sheets P to which the binding operation is applied, is conveyed to an ejection direction by an ejection claw 29, sandwiched between the sheet ejection roller 26 and the driven roller 27, and ejected to the output tray 5.

The saddle-stitching and folding unit 234 is connected to an end of the lower conveyance path 4. In performing a saddle stitching and folding of sheets P, the post-processing controller 210 switches the separator 8 when the sheet P passes through the straight conveyance path 3 and a leading-edge sensor 14 detects the passage of the sheet P. When the separator 8 is switched, the intermediate conveyance roller 12 rotates in reverse to switch back the sheet P and convey the sheet P toward the lower conveyance path 4.

The saddle-stitching and folding unit 234 includes saddle-stitch conveyance rollers 61, 62, and 63, a saddle-stitching stapler 51 serving as a binder, a folding stopper 64 for adjusting a folding position, a folding blade 71 and a folding plate 72. The folding blade 71 contacts the sheet P and presses the sheet P in a direction perpendicular to the sheet surface to perform folding.

The saddle-stitching and folding unit 234 also includes a saddle-stitching ejection roller 73 provided downstream from the folding plate 72 in the direction of conveyance of the sheet P and a saddle-stitching tray 9. When folding is performed by the folding blade 71 and the folding plate 72, the sheet P is ejected to the saddle-stitching tray 9 by the saddle-stitching ejection roller 73.

The punching unit 235 is disposed on a route of the introduction path 1. The punching unit 235 includes a registration detector and a puncher to perform punching at a desired position on the sheet P in consideration of a misregistration detected by the registration detector.

When the post-processing controller 210 determines that such punching is necessary, the post-processing controller 210 performs punching with the punching unit 235 at an appropriate position of the sheet P received.

In the present embodiment, the post-processing apparatus 201 is illustrated in FIG. 1 as a configuration including both the saddle-stitching and folding unit 234 and the punching unit 235. However, in such a configuration, the saddle-stitching and folding unit 234 and the punching unit 235 are removably attached and may be detached from the post-processing apparatus 201. With such a configuration in which components are removably attached, a post-processing apparatus meeting the needs of a user can be provided.

Of the post-processing apparatus 201, when in particular the edge binding unit 233 continuously performs binding with the stapler 50, the remaining number of staples as stapler consumables is checked.

As a method of checking the remaining number of staples with the stapler 50, near-empty display is employed. In such a method, after staples are replenished, the number of times of binding performed using the stapler 50 is recorded on the non-volatile memory 220. When the remaining number of staples is equal to or less than a given threshold, an alert is displayed as the near-empty display indicating that the number of the staples is in a near-empty status. The near-empty display of the present embodiment is an alert display to recommend replenishment of staples when the remaining number of staples is small, although a certain number of staples still remains. However, the configuration of checking the remaining number of staples is not limited to such near-empty display.

Figure 4:
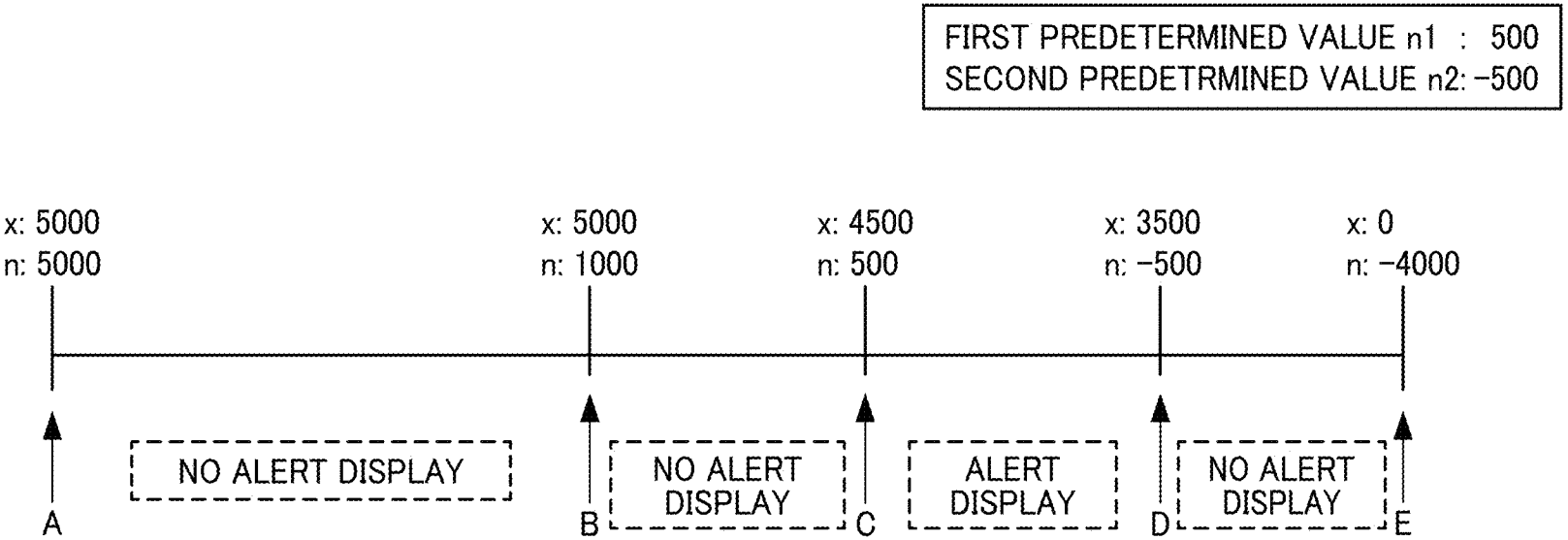
FIG. 4 is a diagram illustrating an example of increase and decrease of the number of staples and corresponding message display statuses when a binding process is performed.

However, in such a mechanism, staples may be replenished while the non-volatile memory 220 is not operating, such as during the power-off. In such a case, although there is a sufficient number of the staples remaining after replenishment, as illustrated in FIG. 4, the remaining number of staples remains recorded and the post-processing controller 210 may continue to display the alert.

Therefore, in the present embodiment, the post-processing controller 210 outputs an alert when the number n of staples stored in the non-volatile memory 220 is equal to or less than a first predetermined value n1 that is a first threshold value. When the number n of staples becomes equal to or less than a second predetermined value n2 that is a second threshold value, the post-processing controller 210 cancels the alert. In the present embodiment, the number n of staples stored in the non-volatile memory 220 is equal to or less than the first or the second threshold value. However, in some embodiments, the number n may be lower than the first or the second threshold value, and what actions occur at the threshold values can be suitably changed according to design values.

A configuration of the above-described mechanism is described with reference to FIG. 4.

First, the initial value of the number n of staples stored in the non-volatile memory 220 is set to 5,000 staples, the first predetermined value n is set to 500 staples, and the second predetermined value n2 is set to −500 (at time point A).

The second predetermined value n2 may be any integer less than the first predetermined value n1, but more preferably zero or a negative integer less than zero.

This is because, as described below, the second predetermined value n2 is preferably a value at which binding is not performed if the number n of staples is correct.

Next, for example, when an edge binding operation is performed with the edge binding unit 233 and 4,000 staples are consumed, the number n of staples stored in the non-volatile memory 220 becomes 1,000 staples, and no alert is displayed yet.

Figure 5:
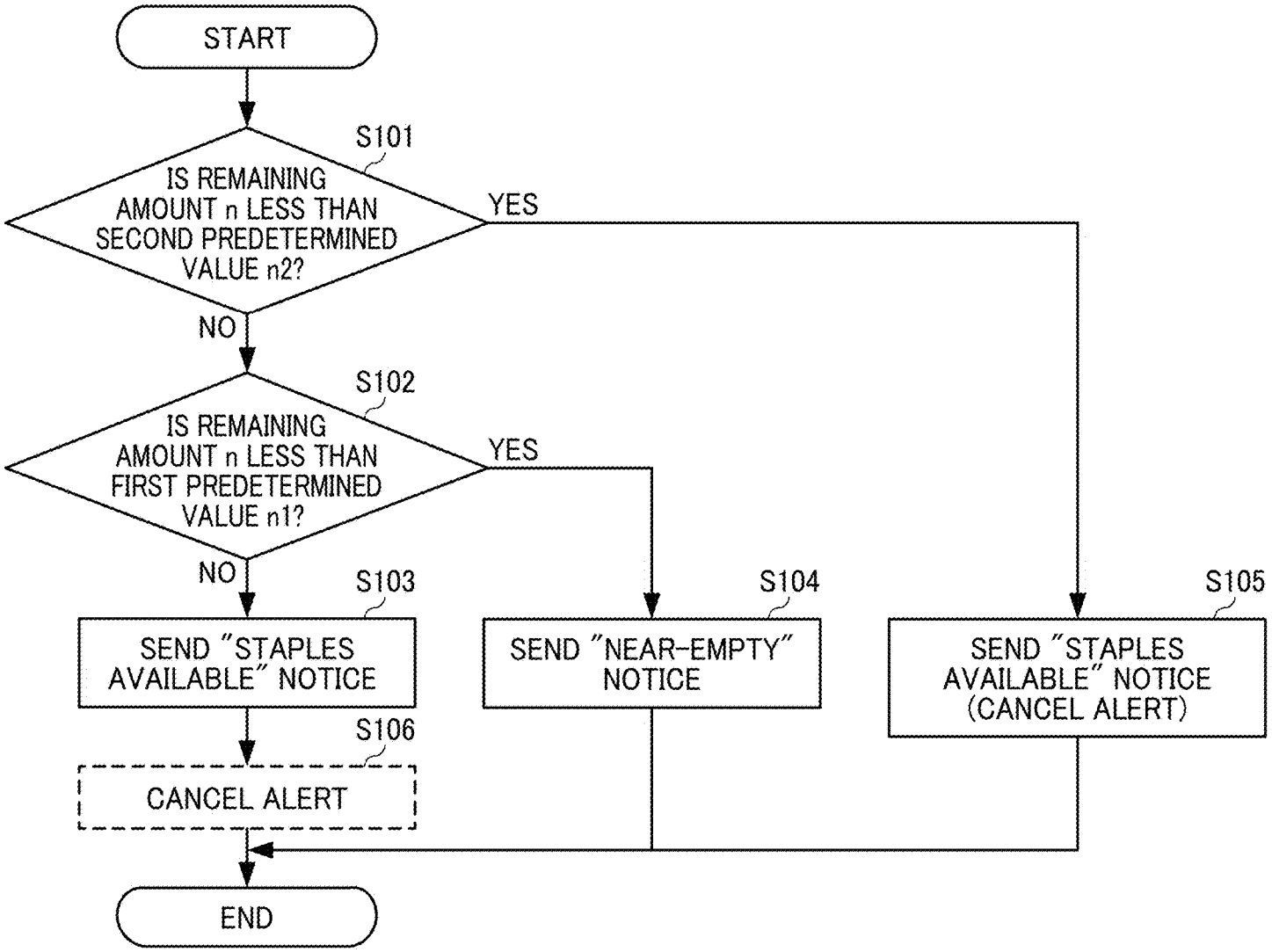
FIG. 5 is a flowchart illustrating an example of a subroutine to determine a near-empty status of the staples in a binding process.

Here, assume that, as illustrated in FIG. 5, a stapler cartridge is replenished during the power-off, and the remaining number n of staplers stored in the non-volatile memory 220 is not updated (at time point B), although the actual number x of staples loaded in the stapler 50 is replenished.

Note that, when the post-processing controller 210 is operating and the remaining number n stored in the non-volatile memory 220 is updated, the remaining number n stored and the actual number x of staples loaded in the stapler 50 match, which causes no problem.

After the stapler cartridge is replenished, the number n of staples stored in the non-volatile memory 220 remains 1,000. Further, when 500 staples are consumed, the post-processing controller 210 determines that the remaining number n of staples is equal to or less than the first predetermined value n1, and displays an alert as a near-empty display of the remaining number of staples on the operation-and-display device 105 via the serial I/F 214 and the serial I/F 114 (at time point C).

However, at the time point C, the actual number x of staples loaded in the stapler 50 is 4,500, and such an alert display is erroneous.

That is, in a conventional method, such an erroneous alert display continues until the remaining number n of staples stored in the non-volatile memory 220 is updated to a correct value, that is, until the staple cartridge is replaced again, resulting in inconvenience of a user.

Hence, in the present embodiment, the second predetermined value n2 is set to reduce the time during which an erroneous-alert display is generated.

For example, assume that, even though an alert is displayed, binding operation is continued. When 1,000 more staples are consumed, the remaining number n of staples becomes −500. As a result, the post-processing controller 210 determines that the remaining number n of staples is equal to or less than the second predetermined value n2, and cancels the near-empty display on the operation-and-display device 105 via the serial I/F 214 and the serial I/F 114 (at time point D).

As described above, the second predetermined value n2 is set in advance and the alert display is canceled when the remaining number n of staples is equal to or less than the second predetermined value n2, thus shortening the time during which an erroneous alert is displayed.

After the remaining number n of staples is less than the second predetermined value n2, the remaining number n of staples stored in the non-volatile memory 220 also continues to decrease as stapling is performed. When the actual number x of staples loaded in the stapler 50 becomes zero (x=0), the post-processing controller 210 displays an end display and stops the edge binding operation (at time point D).

FIG. 5 is a flowchart of a process of the near-empty display operation as described above.

In step S101, the post-processing controller 210 compares the second predetermined value n2 with the remaining number n of staples stored in the non-volatile memory 220.

In step S101, when the second predetermined value n2 is less than the remaining number n of staples, the subroutine proceeds to step S102. The post-processing controller 210 compares the first predetermined value n with the remaining number n of staples stored in the non-volatile memory 220 (step S102).

Alternatively, in step S101, when the second predetermined value n2 is not less than the remaining number n of staples, the post-processing controller 210 cancels the alert as the near-empty display of the staples (step S105).

Note that a subroutine for near-empty status determination as illustrated in FIG. 5 is always in operation when the post-processing controller 210 operates. The remaining number n of staples stored in the non-volatile memory 220 gradually decreases from the initial value, and the second predetermined value n2 is less than the first predetermined value n1 (n2<n1). Therefore, the subroutine needs to go through step S104 at least once before the subroutine goes to step S105.

That is, the near-empty alert of staples is already displayed when the subroutine process transitions to step S105 for the first time.

Next, in step S102, the post-processing controller 210 compares the first predetermined value n1 with the remaining number n of staples stored in the non-volatile memory 220. At this time, if n1 is greater than or equal to n (n1≥n), the process proceeds to step S104 to display the near-empty alert of staples. In step S104, near-empty notification is performed to issue an alert of the remaining number of staples with the operation-and-display device 105.

When n1 is less than n (n1<n), the post-processing controller 210 determines that the remaining number n of staples is sufficient, and sends a notice to the image forming apparatus 101 that the remaining number of staples is sufficient (step S103). When the near-empty alert is displayed, the alert is cancelled (step S106).

Note that in step S105 and step S106, the alert is canceled. However, embodiments of the present disclosure are not limited to the above-described configuration. For example, a configuration may be employed in which a user can select with the operation-and-display device 105 whether the alert is canceled or the output of the alert is continued.

If such a setting is employed, the near-empty display of staples continues. Accordingly, a case where an empty display is displayed abruptly, such as at a time point D in FIG. 4, can be avoided.

Further, since cancelling or continuing the alert display on the operation-and-display device 105 is selectable, a user can grasp that the remaining number n of staples stored in the non-volatile memory 220 and the actual number of staples x are different.

Further, in addition to the above-described configuration, the second predetermined value n2 may be configured to be changeable. In such a configuration, the timing to display the alert display can be arbitrarily changed according to the frequency to use the binding operation by a user or the stock amount of the staples for replenishment. Therefore, it is possible to prompt the user to replace the staples without impairing the convenience for the user.

Next, descriptions are provided of the setting of the second predetermined value n2.

As a matter of course, when the non-volatile memory 220 correctly stores the remaining number n of staples, the remaining number n of staples and the actual number x of staples loaded in the stapler 50 match.

When the remaining number n of staples stored in the non-volatile memory 220 matches the actual number x of staples as described above, it is not possible that the actual number x of staples becomes a negative value. Whenever the actual number x of staples becomes zero (x=0), the post-processing controller 210 displays the empty display and stops the edge binding operation based on a signal received from the staple sensor 52.

On the other hand, if the remaining number n of staples stored in the non-volatile memory 220 is different from the actual number x of the staples loaded in the stapler 50 due to some reasons (such as replenishment of a staple cartridge during the power-off in the present embodiment), the remaining number n of staples may not easily be counted and it is substantially difficult to correct the remaining number x of staples stored in the non-volatile memory 220.

However, if the second predetermined value n2 is arbitrarily set in a range between zero and a negative integer, the actual number x of staples may not become zero (x=0) while the remaining number n of staples becomes equal to or less than n2. Such a case is none other than a state where the remaining number n of staples stored in the non-volatile memory 220 is largely different from the actual number x of staples loaded in the stapler 50.

In the present embodiment, setting the second predetermined value n2 as described above allows the post-processing controller 210 to detect a difference between the actual number x of staples and the remaining number n of staples stored in the non-volatile memory 220.

Further, on a condition in which such a difference is detected, the alert display as a display of the near-empty status of staples is canceled. Such a configuration allows the alert to be correctly canceled even if an erroneous alert display occurs.

Further, the second predetermined value n2 may be arbitrarily determined in a range in which n2 is less than a value obtained by subtracting a maximum loading number of staples from an initial value of the remaining number n. In the setting of the range described above, a case where the remaining number n of staples stored in the non-volatile memory 220 is equal to or less than n2 is none other than a state where the remaining number n of staples stored in the non-volatile memory 220 is largely different from the actual number x of staples loaded in the stapler 50.

In the present embodiment, the initial value and the maximum value are both 5,000 staples, but the initial value and the maximum value may be arbitrarily changed according to the design of the image forming system 100.

Further, although the first predetermined value n1 is equal to 500 (n1=500) and the second predetermined value n2 is equal to −500 (n2=−500) in the present embodiment, the first predetermined value n1 and the second predetermined value n2 may be appropriately determined within the above-described limitations.

Figure 6:
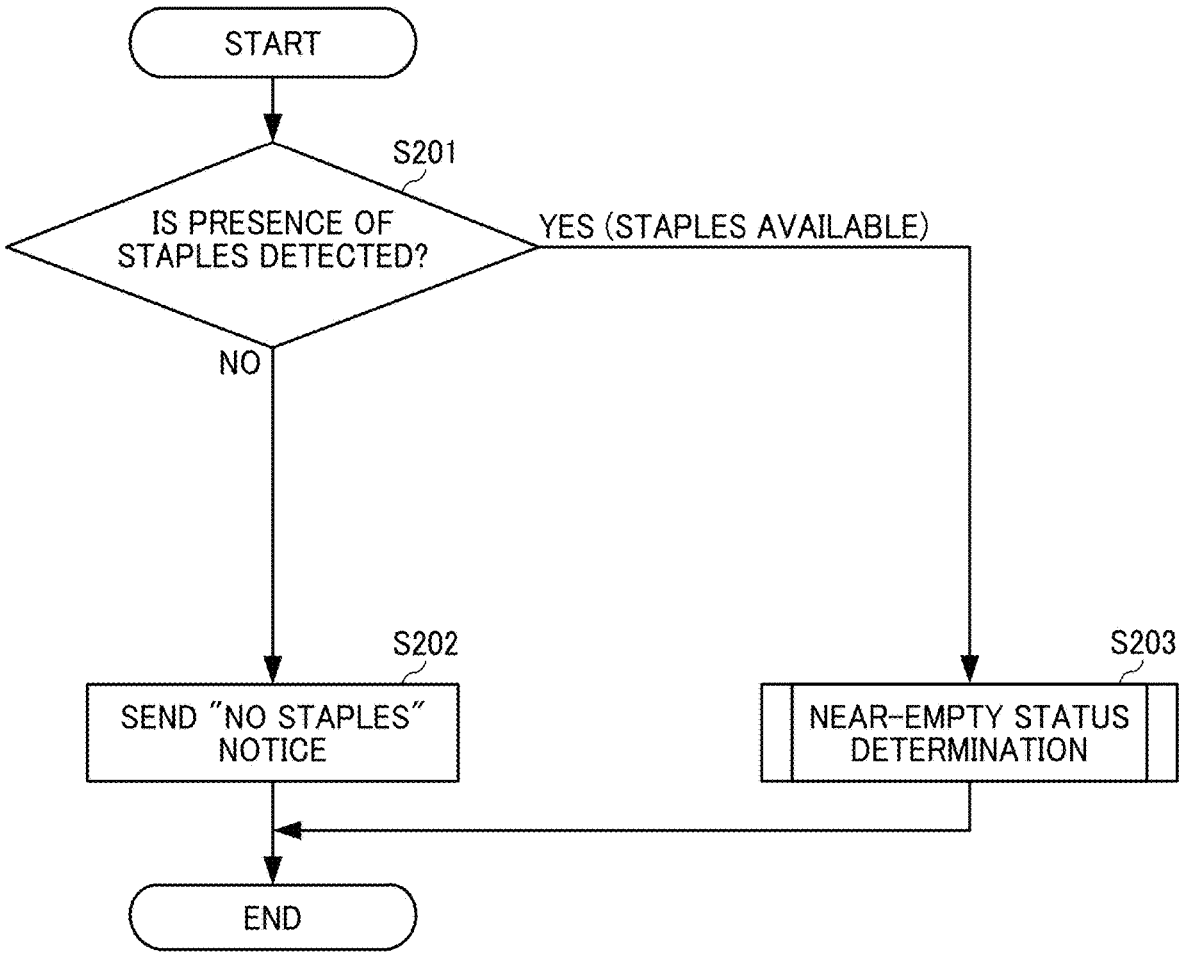
FIG. 6 is a flowchart illustrating an example of a process to determine the presence or absence of the staples with a staple sensor.

FIG. 6 is a flowchart of a subroutine of the present embodiment illustrating a process to determine the presence or absence of staples.

As illustrated in FIG. 6, in step S201, the edge binding unit 233 determines whether the actual number x of staples is zero based on a signal from the staple sensor 52 (step S201).

When the staple sensor 52 detects that the actual number x of staples is equal to zero (x=0), the process proceeds to step S202, and the post-processing controller 210 notifies the operation-and-display device 105 that the staples run out, and stops the binding operation (step S202).

Alternatively, when the staple sensor 52 detects that the actual number of staples x is not zero (x≠0), the process proceeds to step S203 and continues the subroutine of near-empty status determination as illustrated in FIG. 5.

Figure 7:
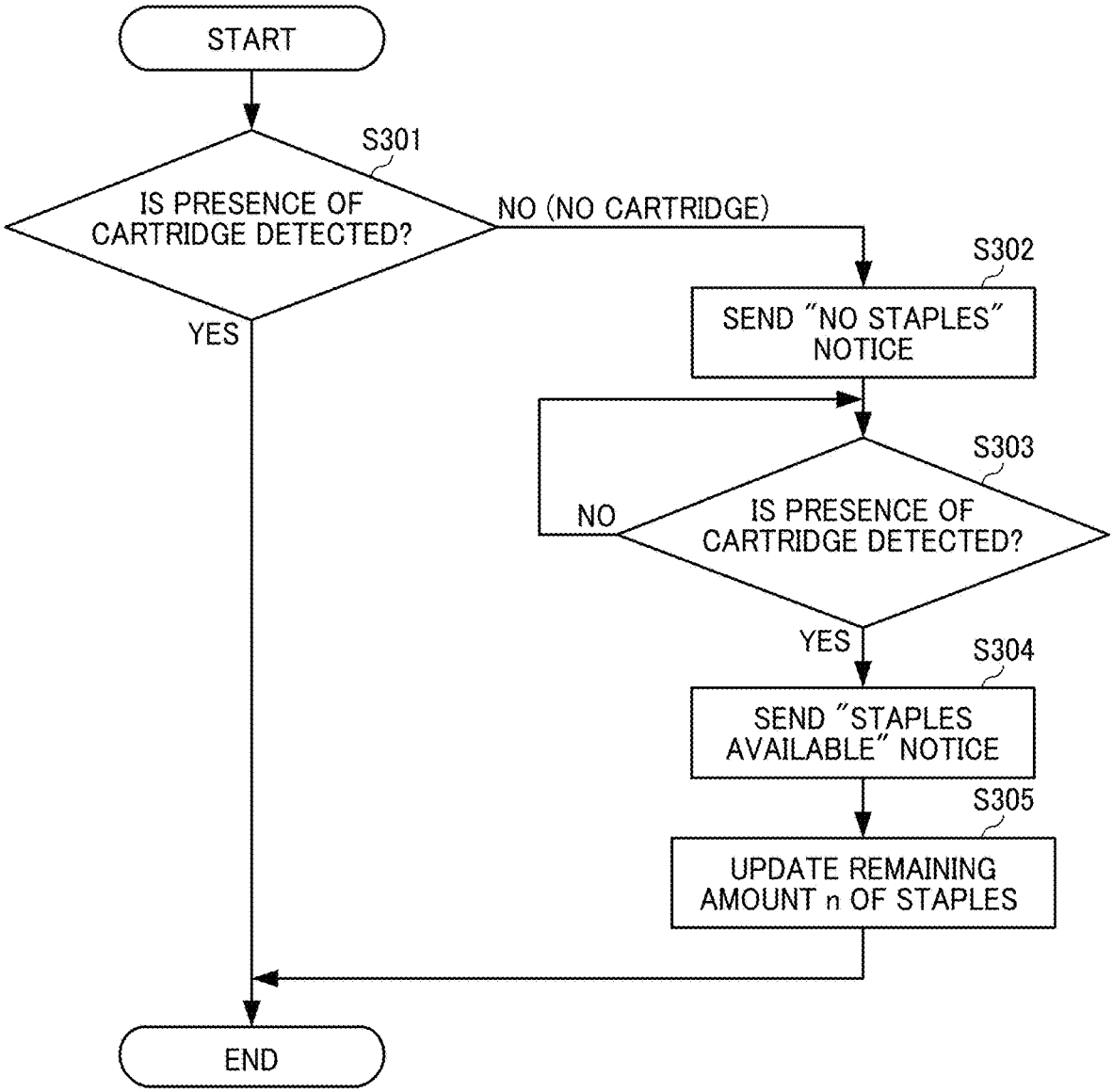
FIG. 7 is a flowchart illustrating an example of a subroutine with a cartridge sensor.

FIG. 7 is a flowchart of a subroutine of the present embodiment illustrating a cartridge replacement process when a cartridge sensor 53 of the stapler 50 is provided.

The cartridge sensor 53 detects whether a cartridge for replenishing staples is connected to the post-processing apparatus 201. The cartridge sensor 53 is included in, for example, the stapler 50.

In step S301, first, when the cartridge sensor 53 detects that the cartridge is not connected, the process proceeds to step S302 to perform notification of the absence of staples, and then proceeds to step S303.

In step S303, the cartridge sensor 53 continues a detection loop until the cartridge is detected. When the cartridge sensor 53 detects the cartridge, the process proceeds to step S304.

In step S304, the post-processing controller 210 notifies the image formation controller 110 that the number x of staples is replenished.

On a condition in which the number x of staples is replenished, the post-processing controller 210 updates the remaining number n of staples stored in the non-volatile memory 220 (step S305) and terminates the subroutine.

As described above, providing the cartridge sensor 53 allows detection of replenishment of staples. Such a configuration can reduce a difference between the actual number x of staples with the remaining number n of staples stored in the non-volatile memory 220.

Figure 8:
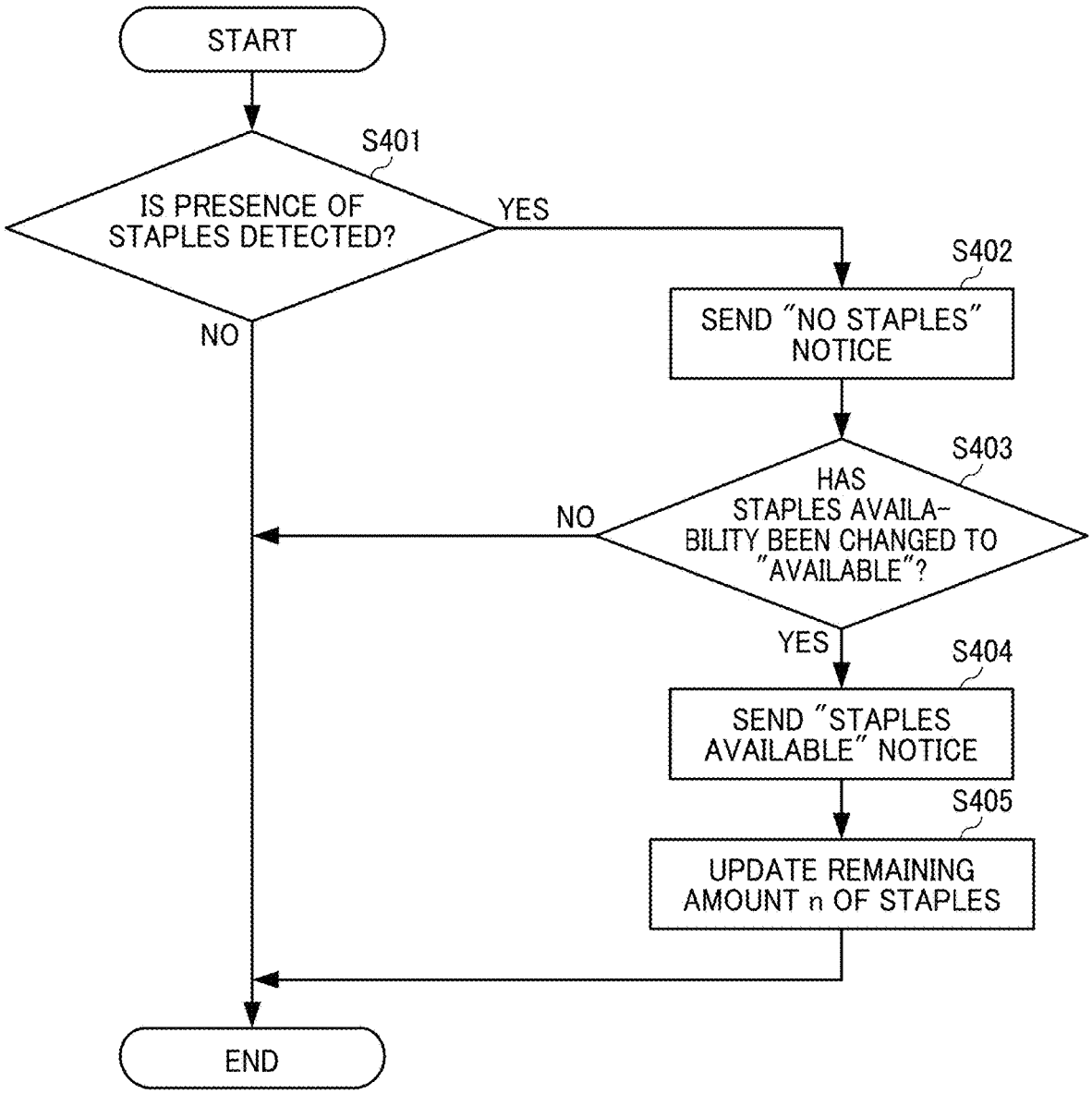
FIG. 8 is a flowchart illustrating an example of a subroutine in a configuration in which the cartridge sensor is not provided.

FIG. 8 is a flowchart of a subroutine of the present embodiment illustrating a cartridge replacement process when the cartridge sensor 53 of the stapler 50 is not provided.

In step S401, first, when a door of the post-processing apparatus 201 is closed and the staple sensor 52 detects that there is no staple, the process proceeds to step S402.

The post-processing controller 210 notifies the image formation controller 110 that the staples run out (step S402).

The staple sensor 52, on a condition in which the door of the post-processing apparatus 201 opens or close, repeatedly performs detection of staples (step S403).

In step S403, when the staple sensor 52 detects the presence of staples after the door of the post-processing apparatus 201 opens and closes, the post-processing controller 210 notifies the image formation controller 110 of the presence of staples (step S404).

In step S404, when the presence of staples is notified, the post-processing controller 210 updates the remaining number n of staples stored in the non-volatile memory 220 (step S405).

If such a subroutine is used, the remaining number n of staples can be updated with the staple sensor 52 even when the cartridge sensor 53 is not provided.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

For example, in the present embodiment, only the post-processing apparatus 201 combined with the image forming apparatus 101 is described as a part of the image forming system 100. However, the present disclosure may be applied to a post-processing apparatus that performs post processing on a recording medium sent from any other terminals. Alternatively, such a post-processing apparatus may be incorporated in the image forming apparatus 101.

In the present embodiment, the image forming system 100 is described. However, for example, a method of checking the remaining number of staples may be performed by a program that executes each of the above-described actions or by various storage media that store the program.

The effects described in the embodiments of this disclosure are listed as examples of most preferable effects derived from this disclosure, and therefore are not limited to the effects described above. In the above descriptions, the term "printing" in the present disclosure may be used synonymously with, e.g. the terms of "image formation", "recording", "printing", and "image printing".

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A binding apparatus to bind sheets comprising;

a binding device configured to bind a plurality of stacked sheets with a binding member;

a non-volatile memory configured to store a quantity of binding members in the binding device; and control circuitry configured to control operation of the binding device, wherein the control circuitry is configured to display an alert upon the quantity of binding members stored in the non-volatile memory being equal to or less than a first value and being configured to cancel the display of the alert upon the quantity of binding members being less than a second value, the second value being less than or equal to zero.

2. The binding apparatus of claim 1;

wherein the control circuitry is configured to set the first value to a value equal to or less than a maximum quantity of the binding members loaded in the binding device and is configured to set the second value to be a value less than the first value.

3. The binding apparatus of claim 1;

wherein the binding apparatus is configured to select whether to cancel display of the alert or continue display of the alert, after the alert is displayed.

4. The binding apparatus of claim 1;

wherein at least one of the first value and the second value is variably settable.

5. The binding apparatus of claim 1;

wherein the first value is a natural number and the second value is zero or a negative integer.

6. An image forming system comprising;

an image forming apparatus configured to form an image on a sheet; and the binding apparatus configured to bind the sheet of claim 1.

7. An image forming system comprising;

an image forming apparatus configured to form an image on a sheet; and the binding apparatus configured to bind the sheet of claim 4.

8. The binding apparatus of claim 1, wherein the control circuitry is configured to cancel the display of the alert upon the quantity of binding members being less than the second value, to prevent erroneous display of the alert.

9. A binding apparatus to bind sheets comprising;

a binding device configured to bind a plurality of stacked sheets with a binding member;

a non-volatile memory configured to store a quantity of binding members in the binding device; and control circuitry configured to control operation of the binding device, wherein the control circuitry is configured to display an alert upon the quantity of binding members stored in the non-volatile memory being equal to or less than a first value and being configured to cancel the display of the alert upon the quantity of binding members being less than a second value, the second value being less than the first value.

10. The binding apparatus of claim 9;

wherein the control circuitry is configured to set the first value to a value equal to or less than a maximum quantity of the binding members loaded in the binding device.

11. The binding apparatus of claim 9;

wherein the binding apparatus is configured to select whether to cancel display of the alert or continue display of the alert, after the alert is displayed.

12. The binding apparatus of claim 9;

wherein at least one of the first value and the second value is variably settable.

13. The binding apparatus of claim 9;

wherein the first value is a natural number and the second value is zero or a negative integer.

14. An image forming system comprising;

an image forming apparatus configured to form an image on a sheet; and the binding apparatus configured to bind the sheet of claim 9.

15. An image forming system comprising;

an image forming apparatus configured to form an image on a sheet; and the binding apparatus configured to bind the sheet of claim 12.

16. The binding apparatus of claim 9, wherein the control circuitry is configured to cancel the display of the alert upon the quantity of binding members being less than the second value, to prevent erroneous display of the alert.

* * * * *